US007605338B2

(12) United States Patent
Karaki et al.

(10) Patent No.: US 7,605,338 B2
(45) Date of Patent: Oct. 20, 2009

(54) MOVABLE CONTACT UNIT AND SWITCH USING THE SAME

(75) Inventors: Minoru Karaki, Okayama (JP); Masahiro Ito, Okayama (JP); Koji Tanabe, Osaka (JP); Hirotoshi Watanabe, Osaka (JP); Yousuke Chikahisa, Hyogo (JP); Yasutaka Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 40 days.

(21) Appl. No.: 11/954,650

(22) Filed: Dec. 12, 2007

(65) Prior Publication Data

US 2008/0142350 A1 Jun. 19, 2008

(30) Foreign Application Priority Data

Dec. 18, 2006 (JP) ..... 2006-339662
Feb. 7, 2007 (JP) ..... 2007-027511

(51) Int. Cl.
*B41J 5/26* (2006.01)

(52) U.S. Cl. ..... 200/406; 200/516

(58) Field of Classification Search ..... 200/406, 200/516
See application file for complete search history.

(56) References Cited

U.S. PATENT DOCUMENTS

| | | | | |
|---|---|---|---|---|
| 3,668,356 | A * | 6/1972 | Kekas | 200/338 |
| 6,329,617 | B1 * | 12/2001 | Burgess | 200/61.43 |
| 6,906,274 | B2 | 6/2005 | Ito et al. | |
| 2006/0062624 | A1 * | 3/2006 | Choi | 400/481 |

FOREIGN PATENT DOCUMENTS

| | | |
|---|---|---|
| JP | 2002-216582 | 8/2002 |
| JP | 2004-193047 | 7/2004 |
| JP | 2005-197147 | 7/2005 |

OTHER PUBLICATIONS

Korean Office Action issued in Korean Patent Application No. KR 10-2007-0128974 dated May 21, 2009.

* cited by examiner

*Primary Examiner*—Gary F. Paumen
(74) *Attorney, Agent, or Firm*—McDermott Will & Emery

(57) ABSTRACT

A movable contact unit includes a base sheet made of polyurethane resin, a domed movable contact made of thin metal sheet, and a pushing protrusion. The movable contact is held on a first face side of the base sheet. The pushing protrusion is formed on a second face of the base sheet at a place corresponding to a domed top of the movable contact.

13 Claims, 5 Drawing Sheets

MOVABLE CONTACT UNIT AND SWITCH USING THE SAME

CLAIM OF PRIORITY

This application claims the benefit of Japanese Patent Application No. JP 2006-339662, filed on Dec. 18, 2006, and Japanese Patent Application No. JP 2007-027511, filed on Feb. 7, 2007 the disclosure of which is incorporated herein by reference.

BACKGROUND OF THE INVENTION

1. Field of the Invention

The present invention relates to a movable contact unit to be used for operating a variety of electronic apparatuses, and a switch using the same movable contact unit.

2. Background Art

In recent years, a variety of electronic apparatuses including portable communication apparatuses such as portable phones have required an easy-to-use and inexpensive operating section. A movable contact unit used in a conventional operating section and the switch employing the movable contact unit are described with reference to FIGS. 9 and 10.

FIG. 9 shows a sectional view of a conventional movable contact unit, and FIG. 10 shows a sectional view of a switch employing the movable contact unit shown in FIG. 9. Movable contact unit 30 includes base sheet 31, movable contact 33, and pushing protrusion 34. Base sheet 31 is made of polyethylene terephthalate (PET) resin film, and has adhesive layer 32 at its underside. Movable contact 33 is made of resilient thin metal plate such as stainless steel, and shapes like a dome open downwardly and bowing upwardly. Movable contact 33 is held at a given place of base sheet 31 with its top face adhering to adhesive layer 32. A plurality of movable contacts 33 is thus constructed. Pushing protrusion 34 is stuck by adhesive 35 on the top face of base sheet 31 at a place corresponding to the domed top of movable contact 33. The most part of protrusion 34 is formed of PET resin. Adhesive 35 is an ultraviolet cure one made from urethane acrylate. Base sheet 31 and pushing protrusion 34 have resin layers 31A and 34A made of ester-based resin at their adhering faces, respectively.

Base sheet 31 has separator 36 stuck with adhesive layer 32 made from an insulating film to its underside for transporting and storing the movable contact unit 30. When movable contact unit 30 is to be in use, remove the separator 36 and stick movable contact unit 30 to wiring board (hereinafter simply referred to as "board") 40, as shown in FIG. 10, by using adhesive layer 32 provided on the underside of base sheet 31. Board 40 has pairs of fixed contacts on its top face. Each pair is formed of center fixed contact 41 and outer fixed contact 42, and the pairs are prepared at places corresponding to respective movable contacts 33. Movable contact unit 30 is stuck to board 40 as discussed above, whereby switch 50 is formed.

Switch 50 is constructed such that the domed top of movable contact 33 is opposite to center fixed contact 41 with a space in between and the lower end of outer periphery of movable contact 33 seats on outer fixed contact 42. Movable contact 33 and a pair of fixed contacts 41, 42 form one switch, and a plurality of the switches forms panel switch 50 to be operated. Operating button 43 of an electronic apparatus is placed over pushing protrusion 43 seating on base sheet 31.

Operation of switch 50, which employs conventional movable contact unit 30 discussed above, is described hereinafter. First, a user pushes button 43 with his/her finger to lower button 43, and then the pushing force is applied to pushing protrusion 34 solidly contacting button 43, and the pushing force is further applied to the top of domed movable contact 33 via base sheet 31. When the pushing force becomes greater than another pushing force that resiliently reverses movable contact 33, the domed section of movable contact 33 reverses inside out, i.e. bowing downwardly, with a click feeling. This reversing allows the underside of the domed top to touch center fixed contact 41, so that fixed contact 41 becomes electrically conductive to fixed contact 42 via movable contact 33.

Release of the pushing force applied to button 43 weakens the another pushing force applied to movable contact 33 via pushing protrusion 34 and base sheet 31, and when this another pushing force becomes smaller than the restoring force of the domed section of movable contact 33 to the original position, movable contact 33 restores to the original domed shape (bowing upwardly) with a click feeling. Movable contact 33 thus leaves center fixed contact 41, and fixed contact 41 is insulated again from fixed contact 42.

Pushing protrusion 34 is placed such that movable contact 33 can be always pushed at its domed top center even if operating button 43 presses a place deviating from the center. This structure allows the click feeling, generated at the reversing and the restoring of movable contact 33, to be stable, so that a good tactile feeling of operation is obtainable.

Base sheet 31, in general, is made of PET resin of which breaking strength is in 200-260 MPa and breaking extension is in 80-140%. In other words, PET resin is a rather hard material, so that the click feeling generated at the resilient reversing of movable contact 33 is degraded. Because movable contact 33 is pressed via base sheet 31 made of PET resin, so that base sheet 31 needs some force to deform itself. When base sheet 31 includes electro luminance elements (EL elements) formed on its underside, the foregoing phenomenon becomes more remarkable.

To prevent the click feeling from being degraded, rather thin base sheet 31 is used, namely, its thickness is in 25 μm-75 μm. Use of a base sheet thinner than this range will damage base sheet 31 when EL elements are printed or sheet 31 is stuck to board 40. There is thus some limit to the improvement of the click feeling at the operation of switch 50.

SUMMARY OF THE INVENTION

The present invention addresses the problem discussed above, and aims to provide a movable contact unit that produces a light click feeling and can be operated with a nice feeling. The present invention also aims to provide a switch using the same movable contact unit. The movable contact unit of the present invention has the following elements:

a base sheet made of polyurethane resin;

a domed movable contact made of thin metal plate; and a pushing protrusion.

The movable contact is held on a first face of the base sheet, and the pushing protrusion is formed on a second face of the base sheet and placed at a position corresponding to a domed top of the movable contact. Use of the polyurethane base sheet can prevent the click feeling from being degraded.

DETAILED DESCRIPTION OF PREFERRED EMBODIMENTS

Figure 1:
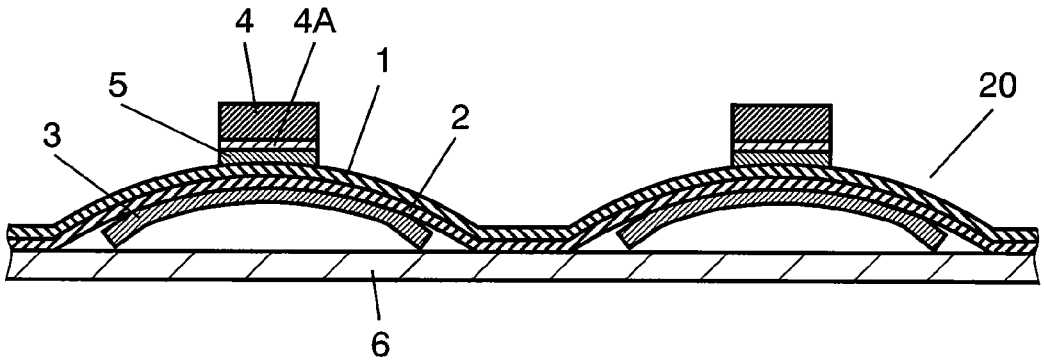
FIG. 1 shows a sectional view of a movable contact unit in accordance with an exemplary embodiment of the present invention.
Figure 2:
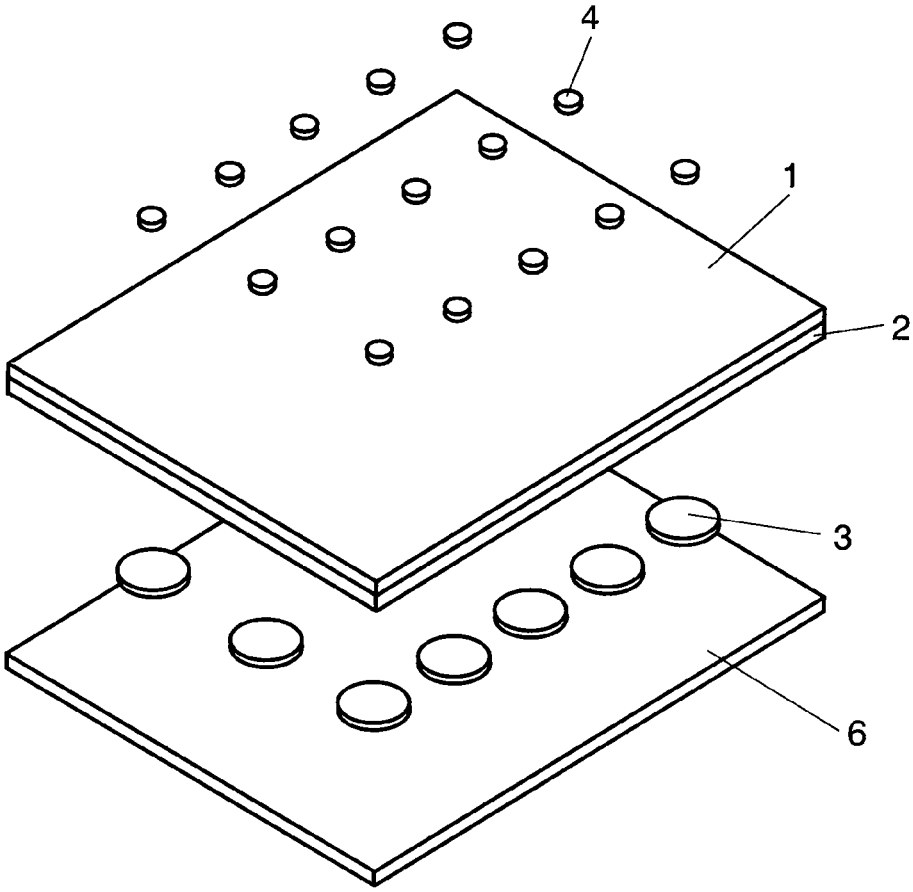
FIG. 2 shows an exploded perspective view of the movable contact unit shown in FIG. 1.
Figure 3:
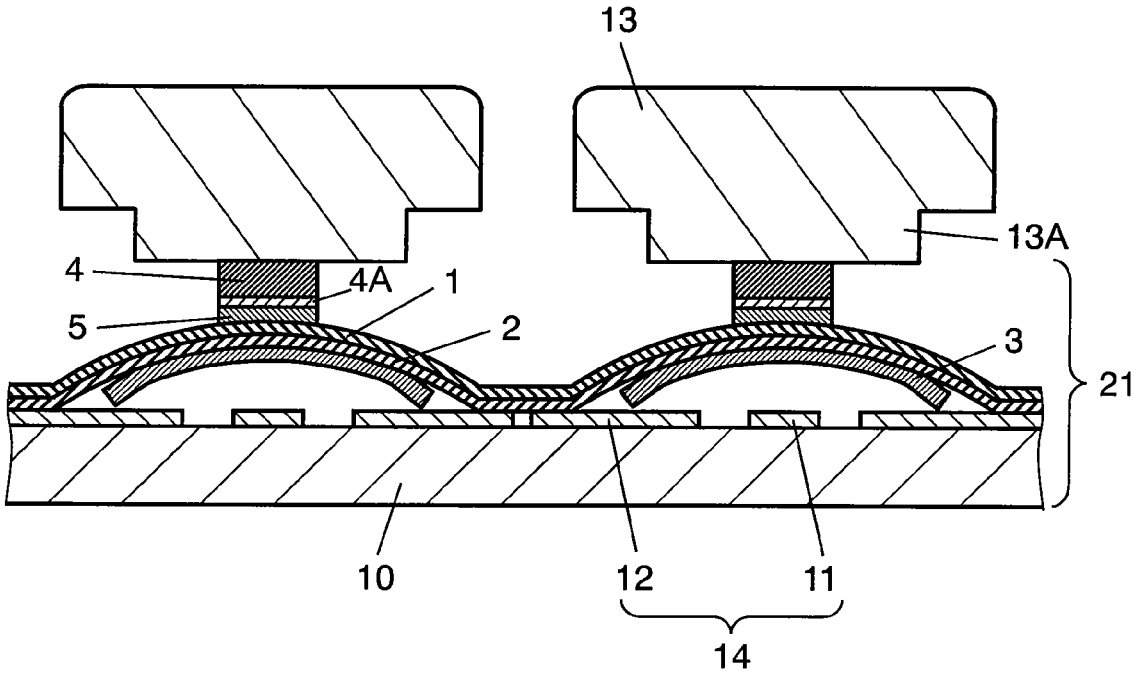
FIG. 3 shows a sectional view of a switch employing the movable contact unit shown in FIG. 1.
Figure 4:
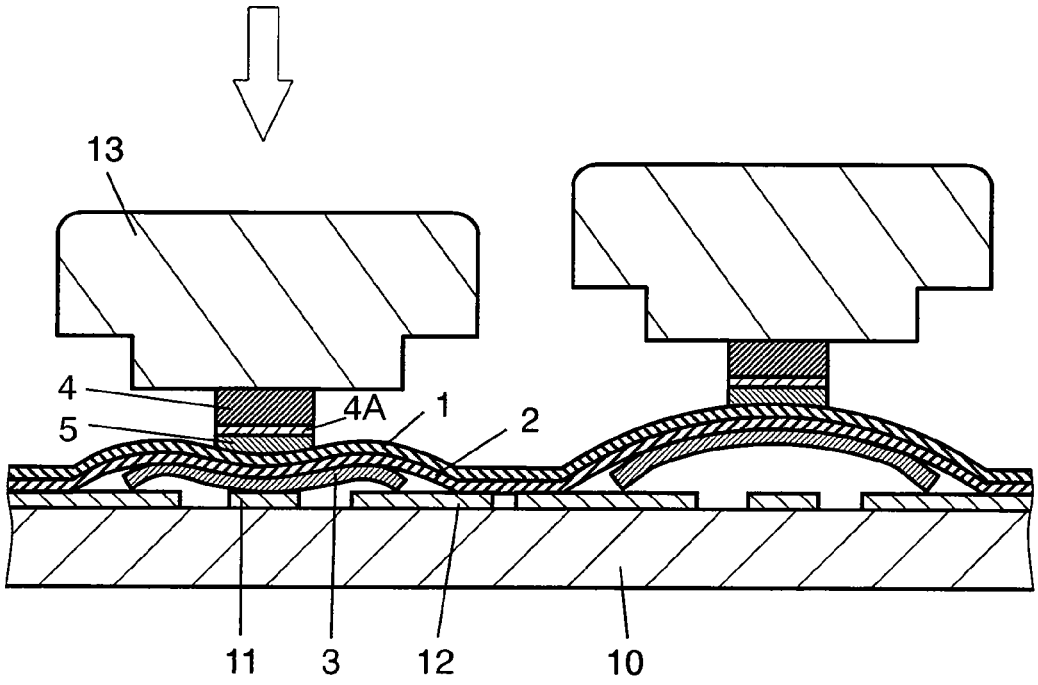
FIG. 4 shows a sectional view of an action of the switch shown in FIG. 3.

FIG. 1 shows a sectional view of a movable contact unit in accordance with an exemplary embodiment of the present invention, and FIG. 2 shows an exploded perspective view of the movable contact unit shown in FIG. 1. FIG. 3 shows a sectional view of a switch employing the movable contact unit shown in FIG. 1, and FIG. 4 shows a sectional view of an action of the switch. Movable contact unit 20 includes base sheet 1, movable contact 3, and pushing protrusion 4.

Base sheet 1 is formed of polyurethane resin film, and has no ester-based resin layer, different from the conventional one, on its top face. Base sheet 1 has adhesive layer 2 made from acryl or butyl rubber on its entire underside (first face). Circular movable contact 3 is made of resilient thin metal plate such as copper alloy, steel or stainless steel, and shapes in a dome open downwardly and bowing upwardly. Predetermined push force applied to movable contact 3 resiliently reverses movable contact 3 with a click feeling, and release of the push force resiliently restores movable contact 3 with a click feeling to its original domed shape open downwardly.

Pluralities of movable contacts 3 are held at predetermined places on base sheet 1 with their domed top faces stuck by adhesive layer 2. Cylindrical pushing protrusion 4 is fixed by adhesive 5 to the position, corresponding to the domed top of movable contact 3, on the top face (second face) of base sheet 1. Pushing protrusion 4 is formed by punching a resin sheet, and the most part of protrusion 4 is made of PET resin. Adhesive 5 is an ultraviolet cure one made from urethane acrylate. Pushing protrusion 4 has resin layer 4A made of ester-based resin at its adhering face.

Base sheet 1 has separator 6 formed of an insulating film such as PET stuck by adhesive layer 2 to its underside. Separator 6 has a thickness of 50-100 μm, and its surface has undergone a release process. Movable contact unit 20 is transported and stored together with separator 6. Use of separator 6 allows protecting the underside of movable contact 3 against oxidization; it also prevents foreign materials from attaching to adhesive layer 2. In other words, as shown in FIG. 1, separator 6 covers the entire underside of base sheet 1, and movable contact 3 is thus held between base sheet 1 and separator 6 for transportation and storage purposes.

When movable contact unit 20 is to be in use, remove the separator 6 from unit 20, and as shown in FIG. 3, stick the unit 20 to wiring board (hereinafter simply referred to as "board") 10 by using adhesive layer 2 provided on the underside of base sheet 1. Board 10 is made from paper phenol or glass epoxy resin, and has pluralities of wiring patterns formed of copper foil on its top face and/or underside. On the top face of board 10, fixed contacts 14 are placed, and each of fixed contacts 14 is formed of a pair of circular center fixed contact 11 and horseshoe-shaped outer fixed contact 12. Respective fixed contacts 14 are placed correspondingly to respective movable contacts 3. To be more specific, movable contact 3 of movable contact unit 20 is stuck to board 10 on the underside of base sheet 1 such that each movable contact 3 confronts fixed contact 14 placed on board 10, whereby switch 21 is constructed.

In switch 21, the domed top of movable contact 3 confronts center fixed contact 11 with a space in between, and the lower end of outer periphery of movable contact 3 seats on outer fixed contact 12. Movable contact 3 and fixed contact 14 form one switch, and a plurality of switches is formed as a whole. Switch 21, formed of these switches and to be used in an operating panel, is thus constructed. Operating unit 13 made of insulating resin is placed over pushing protrusion 4 seating on base sheet 1. Push section 13A protruding from the underside of operating unit 13 solidly contacts pushing protrusion 4. Switch 21 in this status is assembled into an electronic apparatus (not shown), and center fixed contact 11 as well as outer fixed contact 12 are coupled to the circuit (not shown) of the electronic apparatus with a wiring pattern or a connector.

Operation of switch 21, which employs movable contact unit 20 of the present embodiment discussed above, is described hereinafter with reference to FIG. 4. First, a user pushes operating unit 13 with his/her finger to lower operating unit 13, and then the pushing force is applied to pushing protrusion 4 solidly contacting pushing section 13A of operating unit 13, and the pushing force is further applied to the domed top of movable contact 3 via base sheet 1. When the pushing force becomes greater than another pushing force that resiliently reverses movable contact 3, the domed section of movable contact 3 reverses inside out, i.e. bowing downwardly, with a click feeling. This reversing allows the underside of the domed top to touch center fixed contact 11, so that fixed contact 11 becomes electrically conductive to fixed contact 12 via movable contact 3.

Release of the pushing force applied to operating unit 13 weakens the another pushing force applied to movable contact 3 via pushing protrusion 4 and base sheet 1, and when this another pushing force becomes smaller than the restoring force of the domed section to the original position, movable contact 3 restores to the original domed shape (bowing upwardly) with a click feeling. Movable contact 3 thus leaves center fixed contact 11, so that fixed contact 11 is insulated from fixed contact 12 again.

Pushing protrusion 4 is placed such that movable contact 3 can be always pushed at its domed top center even if operating unit 13 presses a place deviating from the center. This structure allows the click feeling, generated at the reversing and the restoring of movable contact 33, to be stable, so that a good tactile feeling of operation is obtainable.

In this embodiment, base sheet 1 employs a resilient sheet made from polyurethane resin of which breaking strength is in 2-10 MPa and breaking extension is in 300-1000%, so that this polyurethane resin sheet is softer, more ductile, and more resilient than PET resin sheet. In other words, base sheet 1 needs small force to be deformed, and when the user pushes operating unit 13 to apply the pushing force to movable contact 3, the resilient deformation of the domed section behaves close to a behavior when movable contact 3 alone is directly pushed. As a result, the click feeling becomes crisp and light.

A click ratio is one of the indexes for evaluating the click feeling as a measured value. The click ratio is found this way: measure an operating force (P1) immediately before the resilient reverse, and another operating force (P2) immediately before the resilient restoring from the resiliently reversed status, and divide the difference between P1 and P2 by P1, then express the result in percentage (%).

Use of a base sheet made of PET resin lowers the click ratio by 3-6% comparing with the click ratio produced in using movable contact 3 alone. Use of base sheet 1 made of polyurethane resin lowers the click ratio only by 1-2%.

Since both of adhesive 5 and base sheet 1 to be suck are made from urethane-based resin, the affinity on the adhering interface between adhesive 5 and base sheet 1 increases, so that there is no need to prepare a resin layer on the adhering face of base sheet 1. As a result, base sheet 1 can be procured with ease. Ultraviolet cure adhesive 5 made from urethane acrylate can be hardened in a short time, so that it is convenient for manufacturing work.

Base sheet 1 is preferably made from thermoplastic polyurethane (TPU). A TPU sheet of which thickness is in 15-100 μm, preferably is around 50 μm, can be used for base sheet 1.

This embodiment uses pushing protrusion 13 made of PET resin which is harder than base sheet 1, so that pushing protrusion 4 can resiliently reverses movable contact 3 in a positive manner even if some deviation between pushing section 13 and movable contact 3 happens at their centers. Because pushing protrusion 4 warps a little in itself, so that the domed top of movable contact 3 can be pushed. In addition, movable contact 3 can be operated with a good feeling.

In the case of using pushing protrusion 4 made from PET resin, resin layer 4A formed of ester-based resin is preferably prepared on the adhering face of protrusion 4, as discussed previously, in order to increase the adhesion strength of protrusion 4.

Figure 5:
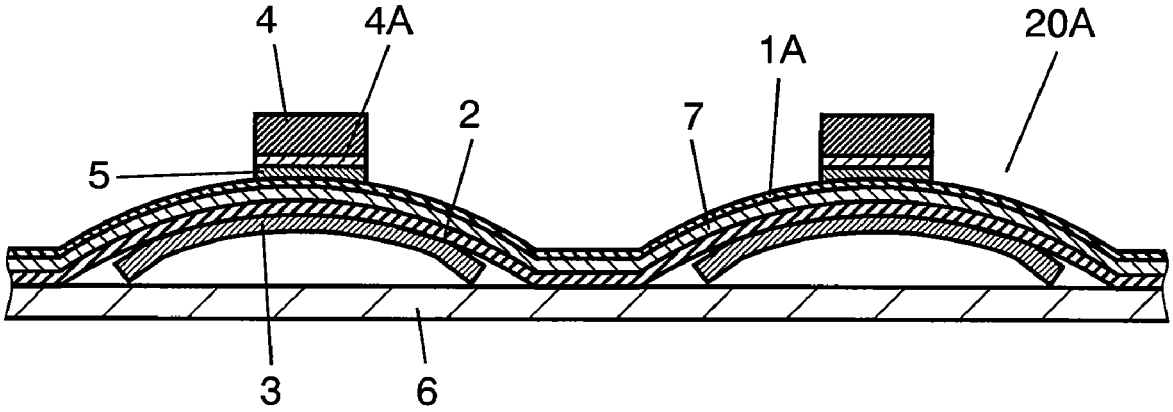
FIG. 5 shows a sectional view of another movable contact unit in accordance with the embodiment of the present invention.
Figure 6:
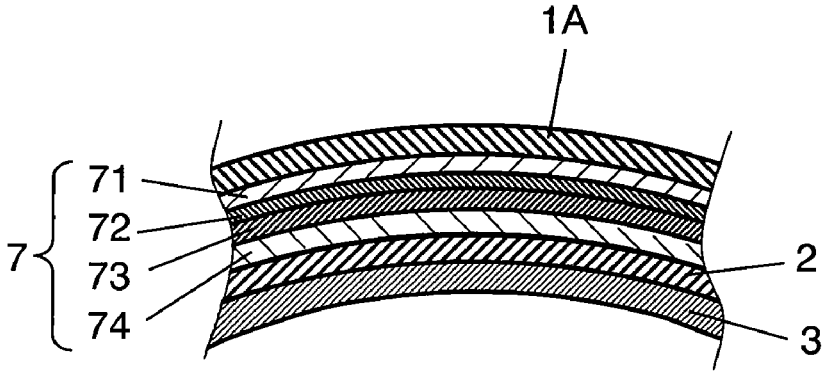
FIG. 6 shows an enlarged sectional view of the movable contact unit shown in FIG. 5.
Figure 7:
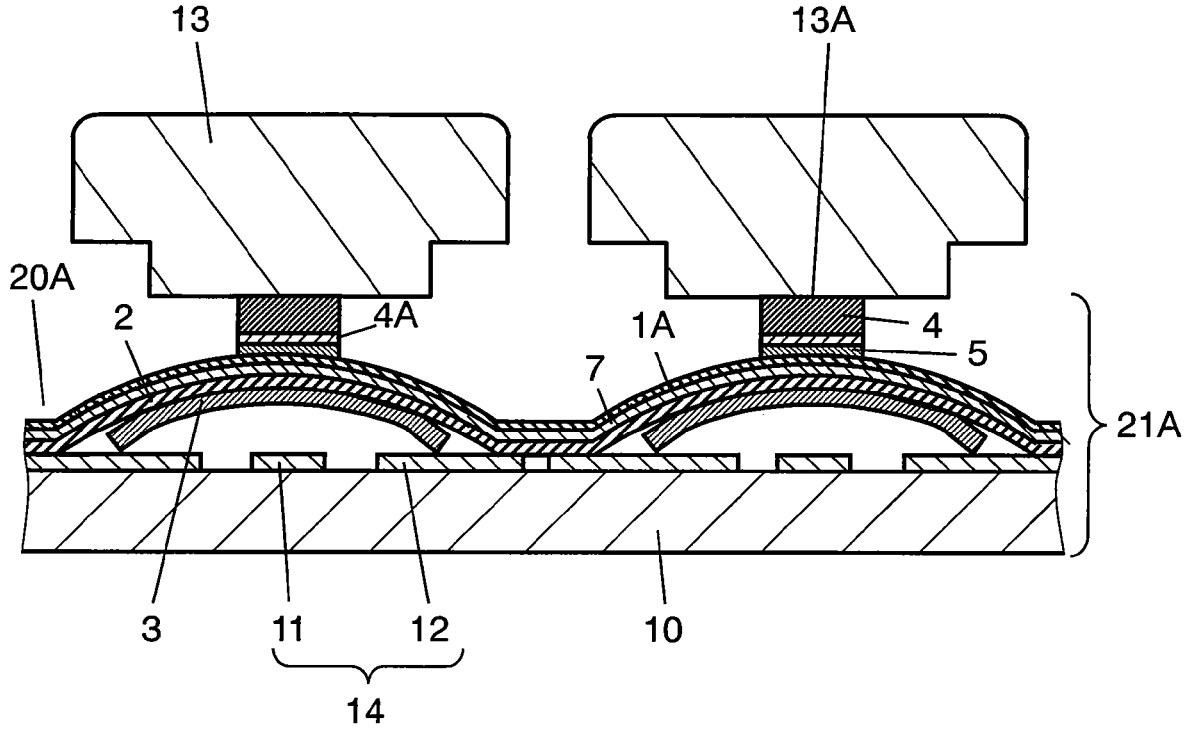
FIG. 7 shows a sectional view of a switch employing the movable contact unit shown in FIG. 5.

Next, a movable contact unit having another structure in accordance with this embodiment is demonstrated hereinafter with reference to FIGS. 5-7. FIG. 5 shows a sectional view of this another movable contact unit in accordance with the embodiment of the present invention, and FIG. 6 shows an enlarged sectional view of the movable contact unit shown in FIG. 5. FIG. 7 shows a sectional view of a switch employing the movable contact unit shown in FIG. 5.

Movable contact unit 20A shown in FIG. 5 differs from movable contact unit 20 shown in FIG. 1 in the following two points: first, flexible and optically-transparent base sheet 1A is used instead of base sheet 1. Second, electro-luminescence element (EL element) 7 is formed on the underside of base sheet 1A, and adhesive layer 2 is formed on the underside of EL element 7. In other words, EL element 7 is provided between base sheet 1A and movable contact 3.

As shown in FIG. 6, EL element 7 includes optically-transparent electrode layer 71, light emitting layer 72, dielectric layer 73, and back electrode layer 74. Optically-transparent electrode layer 71 is formed by printing optically-transparent resin in which indium-tin-oxide is dispersed onto the underside of base sheet 1A. Conductive resin such as polyethylene dioxythiophene can be printed instead of the optically-transparent resin. Light emitting layer 72 is formed in this way: disperse some phosphor such as zinc sulfide which is a base material for light emitting into synthetic resin such as fluoro-rubber, and print the resultant one on the underside of optically-transparent electrode layer 71. Dielectric layer 73 is formed in this way: disperse barium titanate or the like into synthetic resin, and print the resultant one on the underside of light emitting layer 72. Back electrode layer 74 is formed in this way: disperse silver or carbon into resin, and print the resultant one on the underside of dielectric layer 73. An insulating layer made from epoxy resin or polyester resin can be provided for covering these layers. Optically-transparent electrode layer 71 and back electrode layer 74 are coupled to the circuit (not shown) of the electronic apparatus with the wiring patterns or connectors.

The foregoing structure allows switching respective functions of the electronic apparatus in response to an electrical on/off of fixed contact 14 done by pushing operating unit 13. At the same time, the electronic circuit of the apparatus applies a voltage to optically-transparent electrode layer 71 and back electrode layer 74 of EL element 7 for light emitting layer 72 to emit light. This light travels through base sheet 1A and illuminates operating unit 13 from the bottom, so that the user can identify and operate the operating section of the apparatus with ease even in a dark environment.

Base sheet 1A is made from the optically-transparent polyurethane resin as discussed previously, so that the click feeling at the resilient reverse of movable contact 3 is not lost even in the condition where EL element 7 having a thickness of 50-100 μm is formed on the underside of base sheet 1A. The user thus can operate switch 21A with a light and good click feeling.

Figure 8:
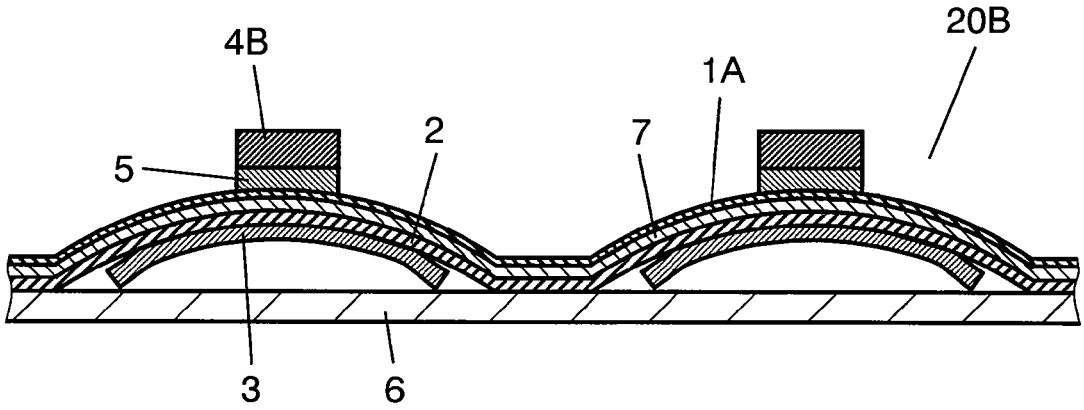
FIG. 8 shows a sectional view of still another movable contact unit in accordance with the embodiment of the present invention.
Figure 9:
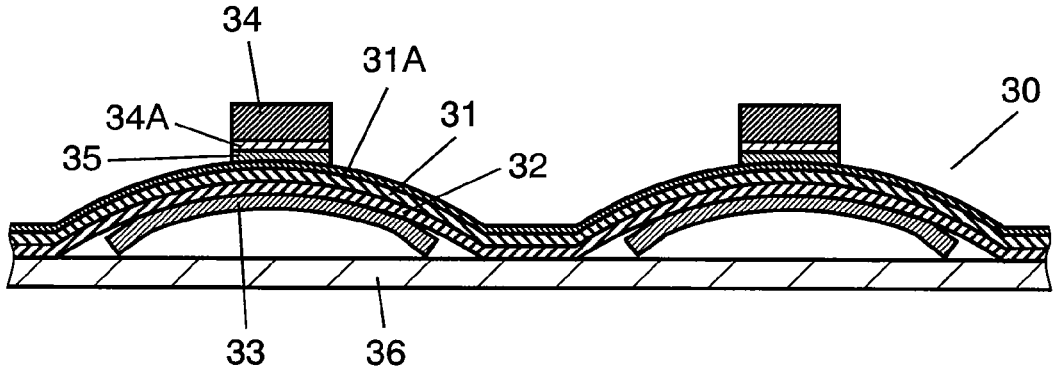
FIG. 9 PRIOR ART
FIG. 9 shows a sectional view of a conventional movable contact unit.
Figure 10:
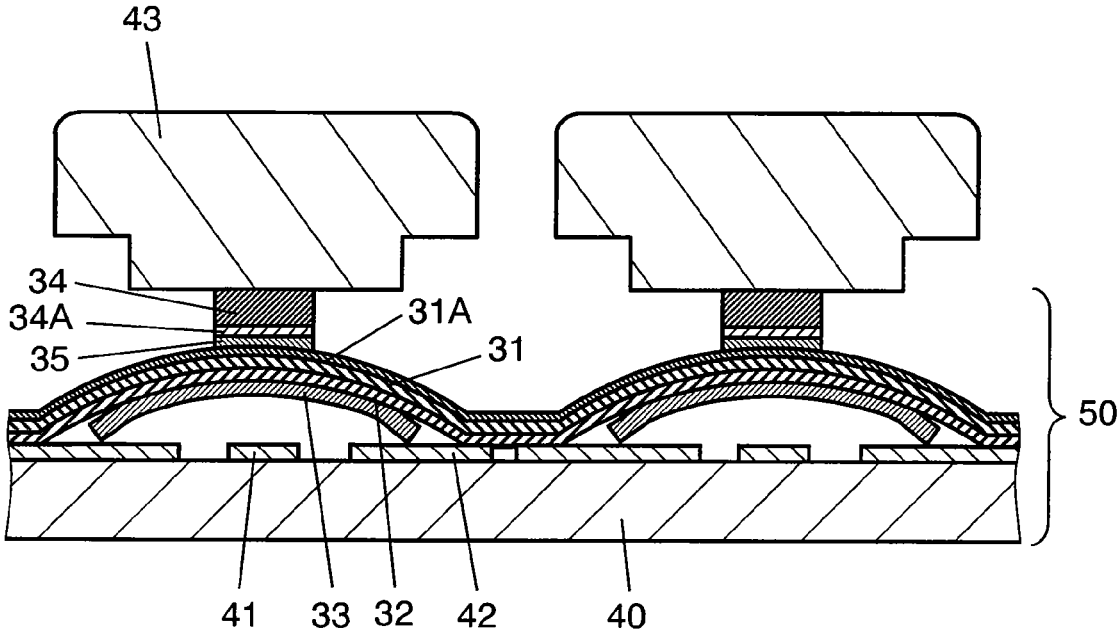
FIG. 10 PRIOR ART
FIG. 10 shows a sectional view of a switch employing the movable contact unit shown in FIG. 9.

Moreover, as shown in FIG. 8, pushing protrusion 4 made of PET resin can be replaced with pushing protrusion 4B made of the material of which hardness is equal to or lower than that of base sheet 1A. Protrusion 4B can be made of TPU resin or silicone resin of a type or a grade having the hardness equal to or lower than that of base sheet 1A, and can be formed by punching a sheet-like material having a thickness ranging from 100 μm to 250 μm.

The use of pushing protrusion 4B allows the user to feel better and softer operating feeling than the use of pushing protrusion 4 made of PET resin, because protrusion 4B pushes movable contact 3 while protrusion 4B warps in itself.

When protrusion 4B is formed of polyurethane resin which is the same material as base sheet 1A, there is no need to form ester-based resin layer 4A that has been formed on the underside of pushing protrusion 4 made of PET resin. Since both of adhesive 5 and pushing protrusion 4B to which adhesive 5 is applied are made of the same material, i.e. urethane-based resin, so that the affinity on the adhering interface between adhesive 5 and protrusion 4B increases. As a result, pushing protrusion 4B can be rigidly stuck to base sheet 1A with strong adhesion.

Use of resilient base sheet 1A and resilient pushing protrusion 4B in the switch where movable contact unit 20B is mounted as shown in FIG. 7 allows operating unit 13 to decrease wobbling. To be more specific, the total height of movable contact unit 20B, i.e. a distance between the underside of adhesive layer 2 at the position to be stuck to board 10 and the top face of protrusion 4B, is set a little bit greater than the distance from the top face of board 10 to the underside of operating unit 13. Then operating unit 13 is assembled with protrusion 4B such that operating unit 13 resiliently contacts protrusion 4B, so that a dimensional error generated at the assembly can be absorbed by the resiliency of protrusion 4B. This mechanism allows completing a quality switch for an operating panel with ease and without wobbles at operating unit 13. Even if a slight gap exists between the underside of operating unit 13 and the top face of pushing protrusion 4B, collision sound between them by the pushing operation cannot be heard thanks to the structure of protrusion 4B, so that a quality switch to be used in an operating panel is obtainable with ease.

In FIG. 8, movable contact unit 20B with EL element 7 is demonstrated; however, the embodiment is not necessarily limited to this instance. For example, pushing protrusion 4B made of the material of which hardness is not greater than that of base sheet 1A can be used without EL element 7. In this case, use of optically-opaque base sheet 1 instead of optically-transparent base sheet 1A will reduce the cost.

Meanwhile, pushing protrusions 4 and 4B can be formed by printing instead of punching a sheet.

As discussed above, the movable contact unit of the present invention and the switch employing the same movable contact unit can be operated with a good click feeling. The movable contact unit and the switch using the same unit are useful for operating a variety of electronic apparatuses.

What is claimed is:

1. A movable contact unit comprising:

a base sheet made of polyurethane resin, and including a first face and a second face opposite to the first face;

a domed movable contact made of thin metal plate and held on the first face side of the base sheet; and a pushing protrusion formed on the second face of the base sheet at a position corresponding to a domed top of the movable contact.

2. The movable contact unit according to claim 1, wherein the base sheet is made of thermoplastic polyurethane resin.

3. The movable contact unit according to claim 1, further comprising an adhesive layer disposed on the first face of the base sheet for adhesively holding the movable contact.

4. The movable contact unit according to claim 1, wherein the base sheet and the pushing protrusion are bonded together by ultraviolet cure adhesive made of urethane acrylate.

5. The movable contact unit according to claim 1, wherein the pushing protrusion is harder than the base sheet.

6. The movable contact unit according to claim 5, wherein the pushing protrusion is made of polyethylene terephthalate.

7. The movable contact unit according to claim 6, wherein the base sheet and the pushing protrusion are bonded together by ultraviolet cure adhesive made of urethane acrylate, and the pushing protrusion includes a resin layer, made of ester-based resin, on a face to be bonded thereof.

8. The movable contact unit according to claim 1, wherein a hardness of the pushing protrusion is at most a hardness of the base sheet.

9. The movable contact unit according to claim 8, wherein the pushing protrusion is made of polyurethane resin.

10. The movable contact unit according to claim 8, wherein the pushing protrusion is made of thermoplastic polyurethane resin.

11. The movable contact unit according to claim 1, further comprising an electro-luminescence element between the base sheet and the movable contact, wherein the base sheet is optically-transparent.

12. A switch comprising:

a movable contact unit including:

a base sheet made of polyurethane resin, and including a first face and a second face opposite to the first face;

a domed movable contact made of thin metal plate and held on the first face side of the base sheet; and a pushing protrusion formed on the second face of the base sheet at a position corresponding to a domed top of the movable contact; and a board including a fixed contact, wherein the movable contact unit is stuck to the board at the first face side of the base sheet such that the movable contact of the movable contact unit confronts the fixed contact of the board.

13. The switch according to claim 12, further comprising an electro-luminescence element between the base sheet and the movable contact, wherein the base sheet is optically-transparent.

* * * * *